US008109792B2

(12) United States Patent
Briano et al.

(10) Patent No.: US 8,109,792 B2
(45) Date of Patent: Feb. 7, 2012

(54) SYSTEM WITH CABLE MODE CONVERTER

(75) Inventors: Robert Briano, Haverhill, MA (US); Jonathan Pearson, Topsfield, MA (US)

(73) Assignee: Analog Devices, Inc., Norwood, MA (US)

( * ) Notice: Subject to any disclaimer, the term of this patent is extended or adjusted under 35 U.S.C. 154(b) by 1554 days.

(21) Appl. No.: 11/470,440

(22) Filed: Sep. 6, 2006

(65) Prior Publication Data

US 2008/0060050 A1 Mar. 6, 2008

(51) Int. Cl.
*H01R 13/66* (2006.01)

(52) U.S. Cl. ..... 439/620.21; 439/502

(58) Field of Classification Search ..... 439/502, 439/503, 620.01, 620.21, 620.22, 620.23
See application file for complete search history.

(56) References Cited

U.S. PATENT DOCUMENTS 7,047,556 B2 5/2006 Cole et al.
7,572,149 B2 * 8/2009 Matsuura et al. ..... 439/620.21

* cited by examiner

*Primary Examiner* — Khiem Nguyen
(74) *Attorney, Agent, or Firm* — Sunstein Kann Murphy & Timbers LLP

(57) ABSTRACT

A compound video cable has a drive interface, a receive interface with a differential-to-single ended converter, and a differential mode data wired transmission medium connected to the drive interface and the receive interface. The differential-to-single ended converter is configured to convert differential mode signals into single ended signals.

21 Claims, 4 Drawing Sheets

SYSTEM WITH CABLE MODE CONVERTER

FIELD OF THE INVENTION

The invention generally relates to cables for transmitting data and, more particularly, the invention relates to cables for transmitting component video within a computer system.

BACKGROUND OF THE INVENTION

Computers often use conventional coaxial cables to communicate with their associated display devices (e.g., cathode ray tube monitors, plasma displays, or liquid crystal display devices). For example, a desktop computer may transmit control and graphical data to a local liquid crystal display device across a conventional coaxial component video cable. These desktop computer systems often use coaxial cables because they transmit signals in a "single ended" format (also referred to as "single ended signals"), which, as known by those in the art, is 1) a standard mode that the transmitting computer transmits the control and graphical signals, and 2) a standard mode that the receiving display device is configured to process the received control and graphical signals.

Although useful, coaxial cables are expensive. Because their cost generally is a function of their length, however, a short coaxial cable may not be considered too expensive when compared to the cost of the overall computer system. For example, in the desktop environment, a $2000 system may have a three foot, $20 coaxial cable connecting its display device with its computer.

Using a conventional coaxial cable to transmit signals across relatively long distances, however, can be expensive. For example, a central server at an airport may transmit graphical data to a remote bank of display devices (also referred to in the art as "monitors") listing flight arrival and departure times. The server could be on the order of up to 1000 feet from the display devices and thus, require a correspondingly long coaxial cable. The cost of appropriate coaxial cabling in such applications consequently can be on the order of, or greater than, the underlying hardware and software.

SUMMARY OF THE INVENTION

In accordance with one embodiment of the invention, a cable has a drive interface, a receive interface with a differential-to-single ended converter, and a differential mode wired transmission medium connected to the drive interface and the receive interface. The differential-to-single ended converter is configured to convert differential mode signals into single ended signals. Stated another way, the differential-to-single ended converter converts one or more differential mode signals into one or more corresponding single ended signals.

In a manner corresponding to the receive interface, the drive interface may have a single differential-to-single converter configured to convert single ended signals into differential mode signals. In some embodiments, the drive interface and receive interface are substantially permanently secured to the transmission medium. Alternatively, the drive interface and receive interface are substantially removably secured to the transmission medium. In the latter case, the receive interface also has a port for directly connecting to a corresponding port of a logic device.

The cable may have a plurality of pins for coupling with a logic device (e.g., a computer or a display device). One or both of the drive interface and receive interface thus may have an additional port for receiving power. This additional port illustratively is uncouplable with the logic device.

Among other things, the transmission medium may have at least one twisted pair of wires. Moreover, one of the two interfaces may have cable compensation (i.e., delay skew compensation and equalization).

In accordance with another embodiment of the invention, a system has a display device, a logic device for forwarding data for generating a display on the display device, and a cable connected between the logic device and the display device. The cable is similar to that discussed above. Specifically, the cable has a drive interface directly connected to the logic device, a receive interface having a differential-to-single ended converter (and directly connected to the display device), and a differential mode data wired transmission medium connected to the drive interface and the receive interface. The differential-to-single ended converter is configured to convert differential mode signals into single ended signals.

The receive interface may have a first port for connecting directly with the display device, and a second port for removably connecting with the transmission medium. The differential-to-single ended converter may be configured to convert differential mode signals received from the second port into single ended signals to be forwarded to the first port.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, rather than having a single ended, coaxial wired transmission medium, a component video cable for connecting two single ended based logic elements has a differential mode wired transmission medium (e.g., a CAT-5 cable). To effectively implement this, the cable has built-in circuitry for converting differential mode signals into single ended signals. Additional embodiments also have built-in circuitry for converting single ended signals into differential mode signals. Details of illustrative embodiments are discussed below.

Figure 1:
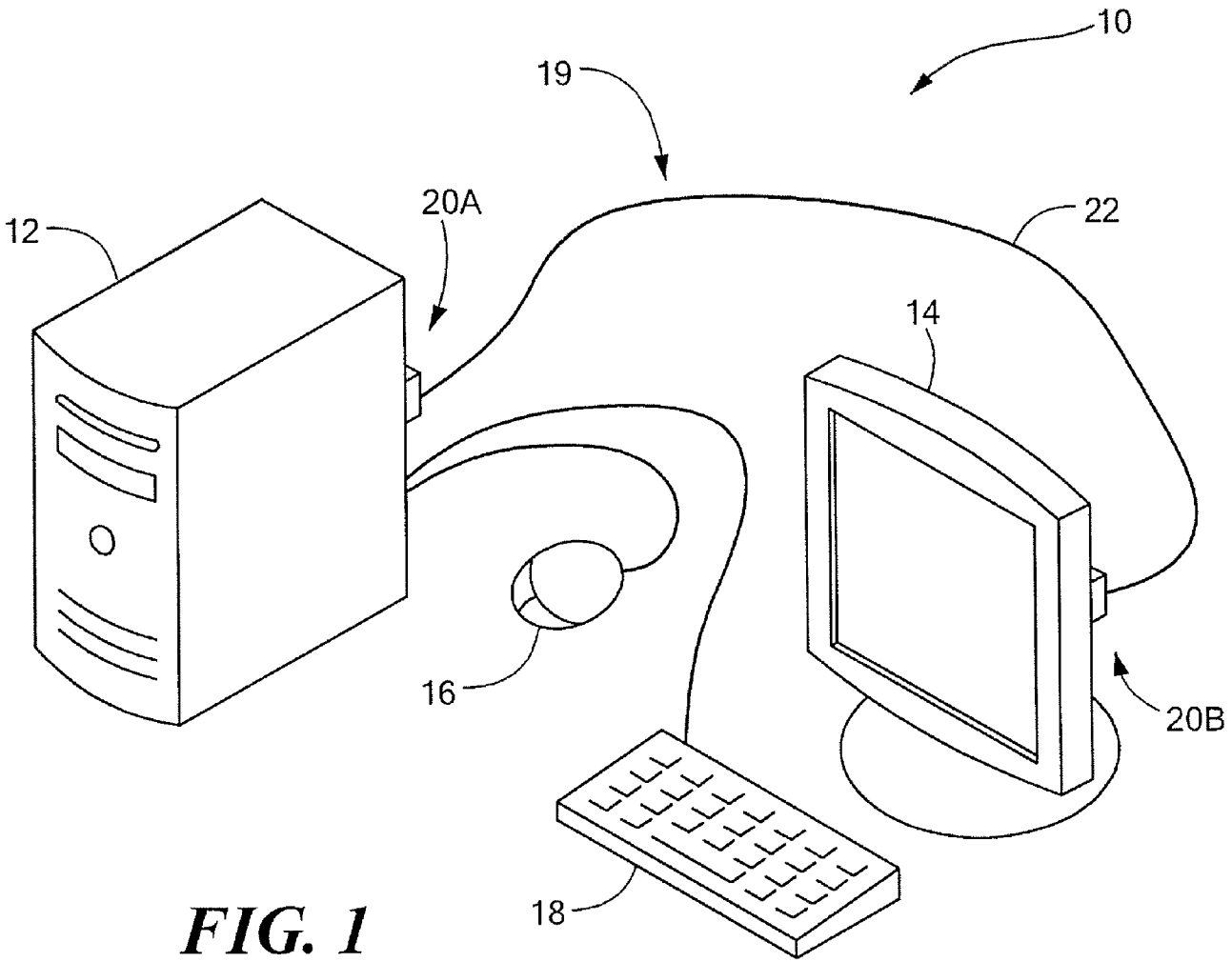
FIG. 1 schematically shows a computer system that may implement illustrative embodiments of the invention.

FIG. 1 schematically shows a computer system 10 that may implement illustrative embodiments of the invention. Among other things, the computer system 10 has a plurality of conventional logic devices, such as a computer 12, one or more display devices 14 (e.g., cathode ray tube display devices, or a liquid crystal display devices), and various input devices (e.g., a mouse 16 and a keyboard 18).

The logic devices may be position in close proximity to each other, such as in a typical desktop computing arrangement, or spaced apart across large distances. Various examples of spaced apart systems include banks of display devices at airports listing flight arrival and departure times, movie theaters, retail stores, other buildings having a logic device that delivers graphical information to remote display devices, and even logic devices controlling operation of display devices outside of a building.

In accordance with illustrative embodiments of the invention, the computer system 10 has a specially configured cable 19 for transmitting component video data between the computer 12 and display device 14. As known by those skilled in the art, component video is a type of analog video format that is transmitted or stored as three or more separate signals. For example, a component video signal may comprise separate red, blue, and green signals. Of course, other types of component video signals may be used. Discussion of one specific type of component video signal therefore is illustrative and not intended to limit various embodiments.

As is common in the art, the display device 14 in FIG. 1 is configured to receive and process component video data received via a single ended signal only. In a corresponding manner, the computer 12 also is configured to transmit a single ended signal to the display device 14 across some connection device. In accordance with illustrative embodiments of the invention, the cable 19

1) receives, from the computer 12, a single ended signal having graphical data, 2) converts this single ended signal into a differential mode signal, 3) transmits this differential mode signal across the majority of the cable 19, and then 4) converts the differential mode signal back to a single ended signal for ultimate delivery to the display device 14.

Because it has this functionality, the cable 19 can have a wired transmission medium 22 (see FIGS. 2A-3, discussed below) that transmits differential mode signals. For example, the wired transmission medium 22 can be similar to that in conventional CAT-5 cables (i.e., twisted wire pairs, discussed below). Accordingly, because differential mode wired transmission media generally are less expensive than coaxial cables, the display device 14 may be more cost effectively positioned very far from the computer 12. For example, the display device 14 could be positioned 100-1000 feet from the computer 12.

Figure 2A:
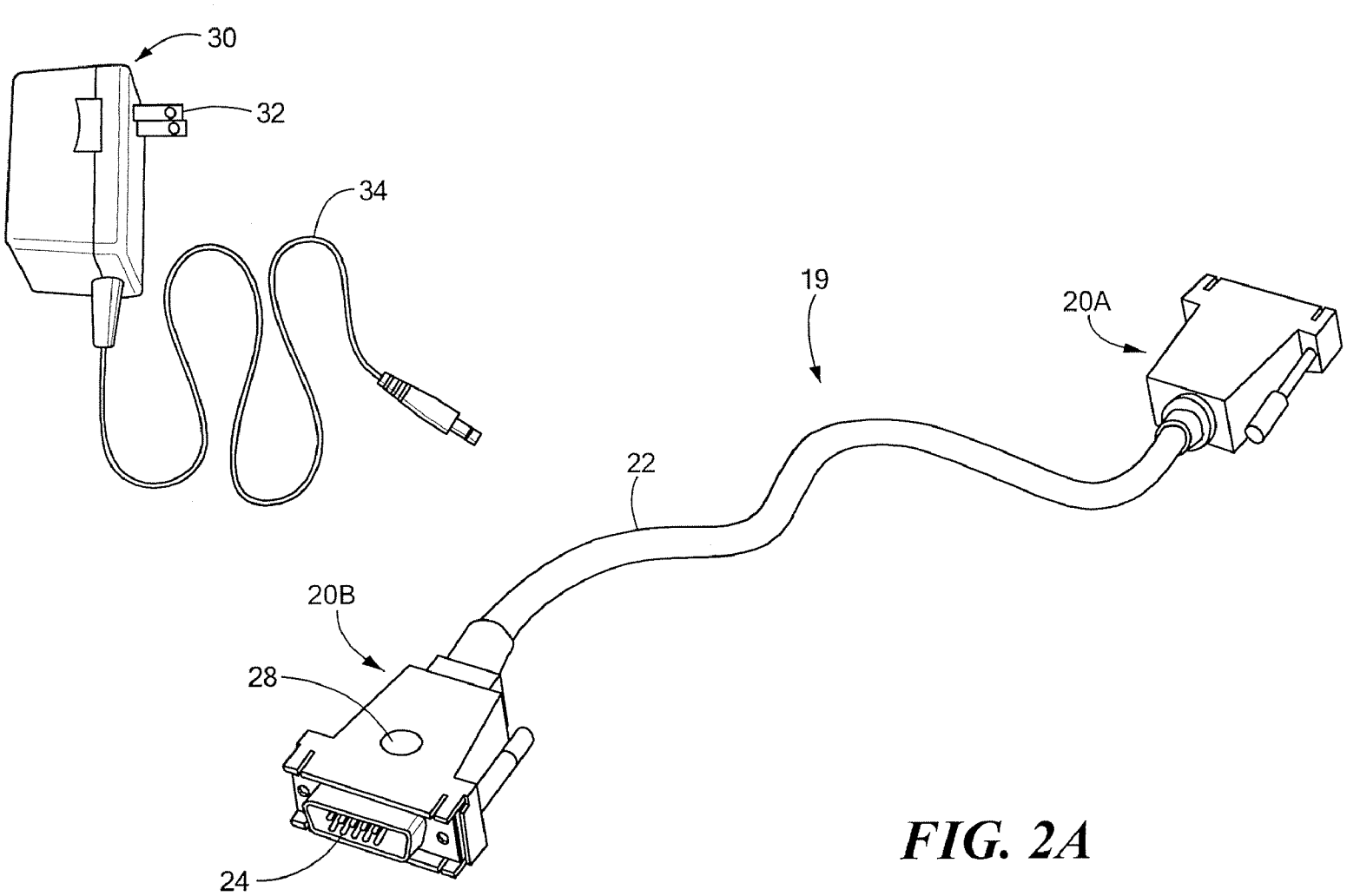
FIG. 2A schematically shows a cable implementing one embodiment of the invention.

FIG. 2A schematically shows additional details of one component video cable 19 implementing one embodiment of the invention. In a manner similar to other component video cables, the cable 19 in FIG. 2A has a drive interface 20A for coupling the cable 19 with the computer 12, a receive interface 20B for coupling the cable 19 with the display device 14, and a differential mode, wired transmission medium 22 connected directly to the two interfaces 20A, 20B. In illustrative embodiments, the wired transmission medium 22 has four twisted-pairs of wires (referred to herein as "twisted pairs 26A-26D," see FIG. 3, discussed below) extending between the interfaces 20A, 20B, and a flexible outer insulator acting as a conduit for containing the twisted-pairs 26A-26D. For example, as noted above, the wired transmission medium 22 could be similar to those used by conventional CAT-5 cables.

Each of the interfaces 20A, 20B therefore has one or more pins 24 corresponding to the wires of the twisted pairs 26A-26D. The interfaces 20A, 20B thus may be similar to other devices conventional used for these purposes, also known as "connectors." Continuing with the example above, three of the four twisted pars 26A, 26B, 26C respectively may be used to transmit red, green, and blue signals, along with certain horizontal and vertical synchronization information. The fourth pair 26D may be used for other purposes, such as for transmitting audio, control, or other data between the display device 14 and computer 12.

As discussed in greater detail below with regard to FIG. 3, circuitry is intergrated directly into the cable 19 to convert signals between a single ended format and a differential mode. This circuitry, which illustratively is located in the interfaces 20A, 20B, must have a power source. In the example above, the fourth twisted par 26D may transmit power to the circuitry from the computer 12, the display device 14, or both the computer 12 and the display device 14. Another embodiment may use batteries.

In illustrative embodiments, the receive interface 20B has a power port 28 (not directly connectable to either of the logic devices) for receiving a DC power signal from a conventional external adapter 30 that converts AC wall voltage to a suitable DC voltage. To that end, the adapter 30 includes a pair of prongs 32 to mate with a standard wall plug (e.g., a home AC outlet, such as those in North America and Europe), and internal transformation and rectification circuitry (not shown) for producing a DC power signal. The DC voltage is applied to the receive interface 20B via an electrical cord 34 that plugs into the power port 28, thus energizing circuitry in both interfaces 20A, 20B. In this case, one or more of the wires within the wired transmission medium 22 (e.g., the fourth twisted pair 26D of the above noted example) transmits the power to the circuitry within the drive interface 20A.

Alternatively, the drive interface 20A could have the power port 28 and thus, transmit power to the circuitry within the receive interface 20B. As another example, both interfaces 20A, 20B have a power port 29 and/or their own source of power. Discussion of the exact location of the power port 28 therefore is illustrative not intended to limit various aspects of the invention.

The wired transmission medium 22 shown in FIG. 2A is considered to be substantially permanently connected/integral to both of its interfaces 20A, 20B. In other words, during normal use, the wired transmission medium 22 is not readily detachable from either of the interfaces 20A, 20B. In addition if detached, such medium 22 is not readily re-attachable to the interfaces 20A, 20B. It can be envisioned, however, that some could forcibly separate the medium 22 from the interfaces 20A, 20B. For example, one could cut the wired transmission medium 22 from one of the interfaces 20A, 20B, or pull apart the medium 22 and one of the interfaces 20A, 20B. If forcible action similar to those discussed is required, for example, then the medium 22 is considered to be permanently connected to the interfaces 20A, 20B.

Figure 2B:
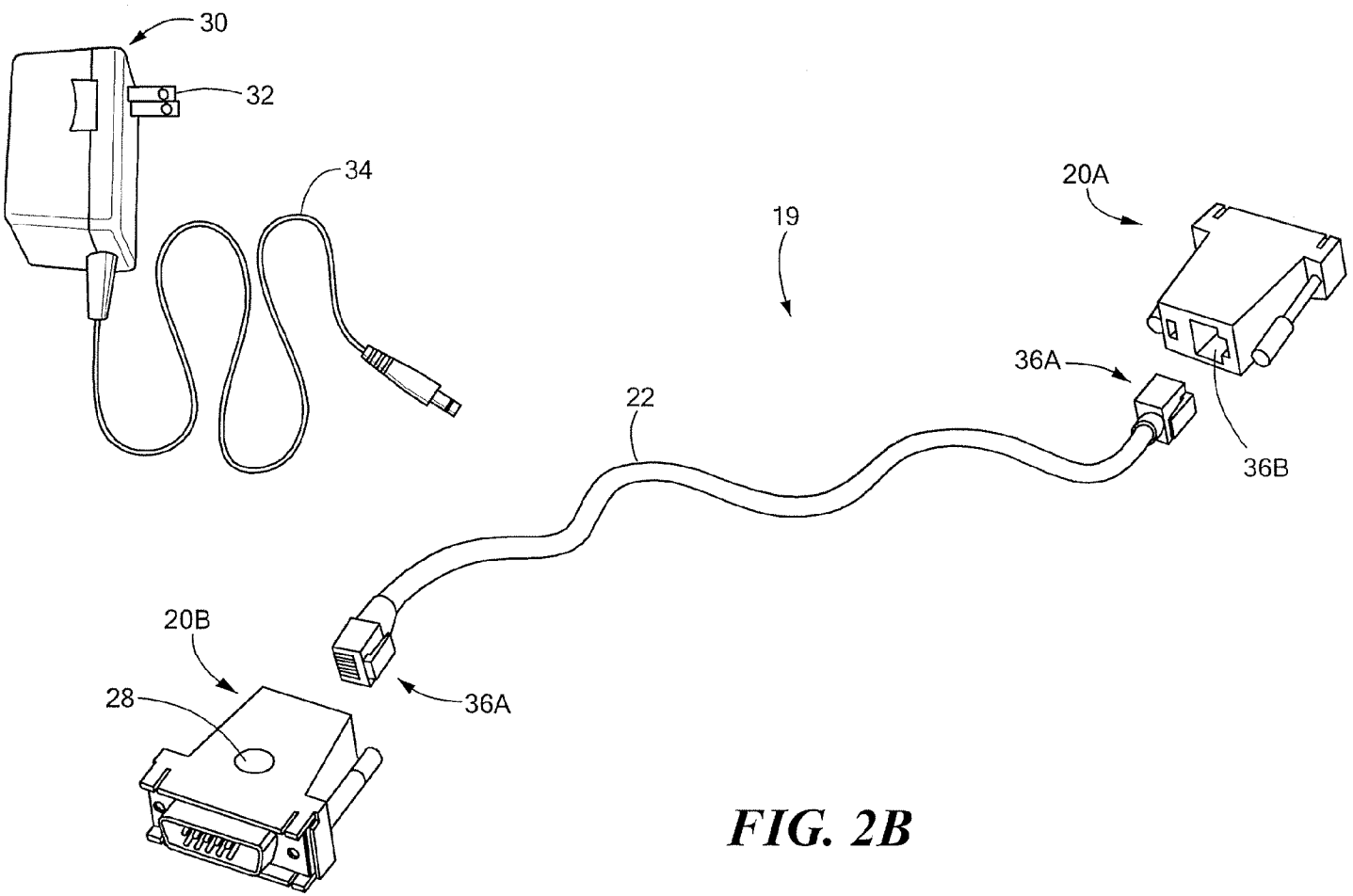
FIG. 2B schematically shows a cable implementing another embodiment of the invention.

In contrast, the wired transmission medium 22 may be removably connected to one or both of the interfaces 20A, 20B. FIG. 2B schematically shows one such embodiment, where each end of the transmission medium 22 has a clip 36A for removably clipping to a corresponding clip port 36B on the interfaces 20A, 20B. Among other things, such clips 36A may be similar to those used in a conventional Ethernet cables or telephone cables.

The cable 19 of FIG. 2B provides number of advantages. Among others, it can be more readily passed along narrow wiring conduits because it does not have the enlarged interfaces 20A, 20B one or both of its ends. In addition, in the event that circuitry in one of the interfaces 20A, 20B malfunctions, only a new interface 20A, 20B must be provided, thus not requiring an entirely new cable 19.

In yet other embodiments, one end of the transmission medium 22 is removably connected to one interface 20A, 20B, while the other end is substantially permanently connected to the other interface 20A, 20B. To implement such an embodiment, one end of the transmission medium 22 may have a clip 36A, and one interface 20A, 20B may have a corresponding clip port 36B.

Figure 3:
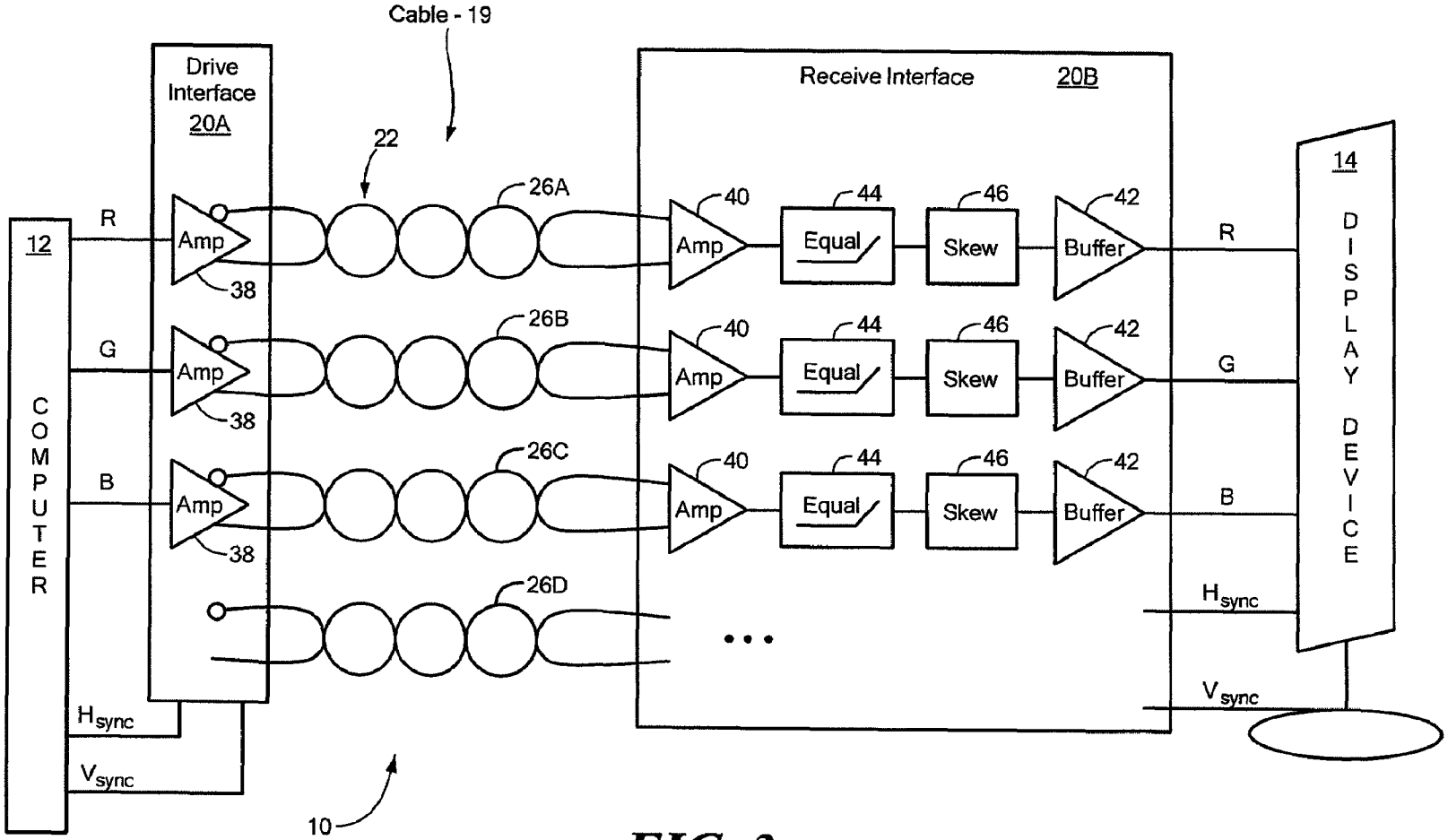
FIG. 3 schematically shows various functional components within the cables shown in FIGS. 2A and 2B.

FIG. 3 schematically shows a generalized electrical diagram of various internal components of the computer 12, cable 19, and display device 14. To that end, FIG. 3 shows additional details of the conversion circuitry within each of the interfaces 20A, 20B, as well as other circuitry that may be within the receive interface 20B. As a preliminary matter, it should be noted that although the drawings schematically shows three signal chains, various embodiments may have more or fewer signal chains. Discussion of three chains thus is for illustrative purposes only.

As shown in FIG. 3, the drive interface 20A has three single ended-to-differential converters 39 for converting single ended signals (received from the computer 12) into differential mode signals to be transmitted across the wired transmission medium 22. In the example shown, one single ended-to-differential converter 38 converts signals with red information, another single ended-to-differential converter 38 converts signals with green information, and a third single ended-to-differential converter 38 converts signals with blue information. In addition, the single ended-to-differential converters 38 also convert horizontal synchronization data and vertical synchronization data.

The single ended-to-differential converters 38 can be any of a wide number of conventionally known converters adapted for this application. For example, among others, one or more of the single ended-to-differential converters 38 may be the AD8134 Triple Differential Driver with Sync-On-Common Mode, distributed by Analog Devices, Inc. of Norwood, Mass.

The receive interface 20B has a corresponding set of differential-to-single ended converters 40 that each convert differential mode signals received from the medium 22 into single ended signals. Continuing with the example in FIG. 3, the receive interface 20B has a first differential-to-single ended converter 40 for converting signals with red information, another differential-to-single ended converter 40 for converting signals with green information, and a third differential-to-single ended converter 40 for converting signals with blue information. By way of example, among others, one or more of the differential-to-single ended converters 40 may be the AD8143 High Speed, Triple Differential Receiver with Comparators, distributed by Analog Devices, Inc.

The resulting single ended signals optionally may be transmitted directly to corresponding buffers 42, and then to the display device 14. Some embodiments of the receive interface 20B, however, have additional circuitry for improving the quality of the signal transmitted to the display device 14. Specifically, the receive interface 20B also may have cable compensation that compensates for delay skew and provides equalization functionality. More specifically, as known by those skilled in the art, the wires within the transmission medium 22 may not be exactly the same length. This may be the result of the wire pairs 26A-26D within the medium 22 having different twist rates. If the wires are not the same length, the resultant signals can be skewed. In addition, if the cable lone enough, the signals may experience some high frequency loss and thus, require equalization.

Accordingly, to compensate for these potential problems, the receive interface 20B has one equalizer 44 coupled to each differential-to-single ended converter 40, and one skew module 46 coupled to each equalizer 44. The equalizers 44 and skew modules 46 may be those conventionally used for these purposes. For example, the AD8128 equalizer, also distributed by Analog Devices, Inc. may be used, while any appropriate conventional analog time delay skew compensator may be used.

FIG. 3 shows the three sets of differential-to-single ended converters 40, equalizers 44, skew modules 46, and buffers 42 as separate components within the receive interface 20B. In some embodiments, however, all of those components are integrated into a single die. In other embodiments, these separate components can be implemented as two or more die having the functionality of one or more of the noted circuit blocks.

Accordingly, during operation, the computer 12 shown in FIG. 3 generates a single ended component video signal for transmission across the cable 19. The single ended-to-differential converters 38 in the drive interface 20A convert this single ended signal to a differential mode signal for transmission across the wired transmission medium 22. Corresponding differential-to-single ended converters 40 in the receive interface 20B convert these signals back to single ended signals, which, optionally, then are equalized and skew compensated before transmission to the display device 14. The display device 14 then processes the data received in the single ended signal to ultimately produce a visual display.

Although the above discussion discloses various exemplary embodiments of the invention, it should be apparent that those skilled in the art can make various modifications that will achieve some of the advantages of the invention without departing from the true scope of the invention.

What is claimed is:

1. A component video cable comprising:

a drive interface;

a receive interface having a differential-to-single ended converter; and a differential mode wired transmission medium connected to the drive interface and the receive interface, the differential-to-single ended converter being configured to convert at least one differential mode signal into at least one single ended signal.

2. The component video cable as defined by claim 1 wherein the drive interface has a single ended-to-differential converter configured to convert at least one single ended signal into at least one differential mode signal.

3. The component video cable as defined by claim 1 wherein the drive interface and receive interface are substantially permanently secured to the transmission medium.

4. The component video cable as defined by claim 1 wherein the drive interface and receive interface are substantially removably secured to the transmission medium, the receive interface also having a port for directly connecting to a corresponding port of a logic device.

5. The component video cable as defined by claim 1 further having a plurality of pins for coupling with a logic device, one of the drive interface and receive interface having an additional port for receiving power, the additional port being uncouplable with the logic device.

6. The component video cable as defined by claim 1 wherein the transmission medium comprises a twisted pair of wires.

7. The component video cable as defined by claim 6 wherein the transmission medium comprises four twisted pairs of wires, one of the twisted pairs of wires being for transmitting at least one of control information, power or audio information.

8. The component video cable as defined by claim 1 wherein one of the receive interface and drive interface comprises cable compensation.

9. A system comprising:

a display device;

a logic device for forwarding data for generating a display on the display device; and a component video cable connected between the logic device and the display device, the cable comprising:

a drive interface directly connected to the logic device;

a receive interface having a differential-to-single ended converter and directly connected to the display device; and a differential mode wired transmission medium connected to the drive interface and the receive interface, the differential-to-single ended converter being configured to convert differential mode signals into single ended signals.

10. The system as defined by claim 9 wherein the receive interface has a first port for connecting directly with the display device and a second port for removably connecting with the transmission medium, the differential-to-single ended converter being configured to convert differential mode signals received from the second port into single ended signals to be forwarded to the first port.

11. The system as defined by claim 9 wherein the drive interface has a single ended-to-differential converter configured to convert single ended signals into differential mode signals.

12. The system as defined by claim 9 wherein the drive interface and receive interface are substantially permanently secured to the transmission medium.

13. The system as defined by claim 9 wherein one of the drive interface and receive interface has an additional port for receiving power, the additional port being uncouplable with the logic device.

14. The system as defined by claim 9 wherein the transmission medium comprises a twisted pair of wires.

15. The system as defined by claim 9 wherein one of the receive interface and drive interface comprises cable compensation.

16. A component video cable comprising:

a drive interface;

a receive interface having means for converting differential mode signals into single ended signals; and a differential mode wired transmission medium between the drive interface and the receive interface.

17. The component video cable as defined by claim 16 wherein the drive interface has means for converting single ended signals into differential mode signals.

18. The component video cable as defined by claim 16 further comprising means for powering the converting means.

19. The component video cable as defined by claim 16 further comprising means for removably coupling the transmission medium with the receive interface.

20. The component video cable as defined by claim 16 wherein one of the receive interface and drive interface comprises cable compensation.

21. The component video cable as defined by claim 16 wherein the transmission medium comprises a twisted pair of wires.

* * * * *